US005881408A

United States Patent [19]

Bashista et al.

[11] Patent Number: 5,881,408

[45] Date of Patent: Mar. 16, 1999

[54] MESH CRIB LINER

[76] Inventors: Doreen Anne Bashista; Ronald S. Bashista, both of 65 Pleasant St., Southampton, Mass. 02073

[21] Appl. No.: 859,987

[22] Filed: May 21, 1997

[51] Int. Cl.[6] ..... A47C 21/08

[52] U.S. Cl. ..... 5/663

[58] Field of Search ..... 5/93.1, 424, 427, 5/663, 946

[56] References Cited

U.S. PATENT DOCUMENTS

| | | | |
|---|---|---|---|
| 2,128,978 | 9/1938 | Akin | 5/946 X |
| 2,566,790 | 9/1951 | Bloomfield | 5/93.1 |
| 3,438,069 | 4/1969 | Long | 5/98.1 X |
| 4,232,415 | 11/1980 | Webber | 5/427 |
| 4,370,765 | 2/1983 | Webber | 5/663 X |
| 5,566,407 | 10/1996 | Lien | 5/663 X |
| 5,575,025 | 11/1996 | Peters | 5/663 X |

*Primary Examiner*—Michael F. Trettel
*Attorney, Agent, or Firm*—Wolf, Greenfield & Sacks, P.C.

[57] ABSTRACT

A crib liner having side panels made of netting which cover the inside of the crib side rails and having very small openings therein which prohibit a child from putting its fingers or toes therethrough. The side panels carry quilted extensions which releasably close over the tops of the side rails.

8 Claims, 2 Drawing Sheets

MESH CRIB LINER

BACKGROUND OF THE INVENTION

This invention relates to crib liners and, more particularly, to crib liners for preventing an infant or young child from extending its limbs through the spaces between the vertical slats of the side rails.

Conventional baby cribs include side rails that are made up of top and bottom horizontal bars interconnected by a series of spaced apart slats. Frequently babies and toddlers while sleeping or playing in their cribs intentionally or accidentally extend their limbs out of the crib between the slats and have difficulty drawing them back into the crib. If this occurs when the child is sleeping, the extended limbs will remain uncovered and become cold, and the child will ultimately awaken. The problem is more acute when crib bumpers are employed because the child's limb may extend between the slats and under the bumpers so that movement of the limb is severely restricted and it is more difficult for the child to draw it back into the crib. Many cribs have head boards and foot boards that are also made with spaced apart vertical slats, and the baby may extend its arms or legs out of the crib between those slats as well.

The prior art includes a member of patents directed to liner-like device for cribs and playpens that perform a variety of functions. For example, Long U.S. Pat. No. 3,438,069 discloses a crib warmer having sides which are disposed within the crib and contains flexible tubes through which heated fluid passes. The side walls of the device are imperforate so that air cannot freely circulate within the crib and a child in the crib is not clearly in view. Turner U.S. Pat. No. 3,183,527 discloses a net material for enclosing a child in a confined space, but the openings in the netting are too large to prevent a child's limbs from extending through them and would actually enable a child to climb out of the enclosure. The Moltane U.S. Pat. No. 2,784,420 shows a playpen construction wherein netting is supported by a tubular frame and defines the side walls of the enclosure. The openings are not so small as to prevent a child from pulling him/herself up and over the top of the side by grasping the netting through the openings. Mundis U.S. Pat. No. 3,103,669 discloses a crib shield that wraps around the outside of the side rails and includes a small elastic section that is somewhat transparent and allows the flow of air to the crib interior, but the shield will not prevent a child from extending a limb between the slats because the liner lies outside the crib. Ruiz U.S. Pat. No. 2,927,331 shows an insect netting for cribs which totally enclosed the crib interior by virtue of its four side walls and bottom and top walls. The side and top walls of the netting are supported only from the four comer posts of the crib and therefore the netting is susceptible to being pulled from the side rails and head and foot boards of the crib and becoming entangled about the child.

The primary object of the present invention is to provide a crib liner which prohibits a child from extending its limbs out of the crib between the slats.

Another important object of this invention is to provide a crib liner which safely confines a child within its crib and does not enable the child to climb out of the crib by pulling itself up on the liner over the side rail.

Another object of the present invention is to provide a crib liner that confines a child within the crib but does not impede visual monitoring of the child or the circulation of air about and within the crib.

Another object of the present invention is to provide a crib liner which does not interfere with the mounting of crib bumpers within the crib.

To accomplish these and other objects, the crib liner of the present invention is made of a fine mesh whose openings are too small to permit the fingers or toes of a child to extend through its and which is nevertheless transparent so that the child can be viewed in the crib through the liner and further permits the free circulation of air in the crib. The liner fits within the crib and has a bottom panel disposed beneath the mattress and side and end panels that extend upwardly on the inside of the side rails and head board and foot board of the crib. The upper edges of the side panels carry quilted extensions that extend over and about the top bars of the side rails, and convenient fasteners are provided in the side panels and extensions which enable the two to be secured together between the slats of the side rails. The upper edges of both end panels are provided with sleeves that carry rods which enable them to be secured to the head board and foot board. Ties are provided at the ends of the sleeves for that purpose. The lower ends of the end panels also carry ties which enable the bottom of each end panel to be secured in place. The liner is placed in the crib and the crib mattress is thereafter dropped into place. The mattress serves to retain the liner in place and prevents the child in the crib from pulling the bottom of the end panels or the side panels above the mattress.

These and other objects and features of the present invention will be better understood and appreciated from the following detailed description of one embodiment thereof, selected for purposes of illustration and shown in the accompanying drawings.

DETAILED DESCRIPTION

Figure 1:
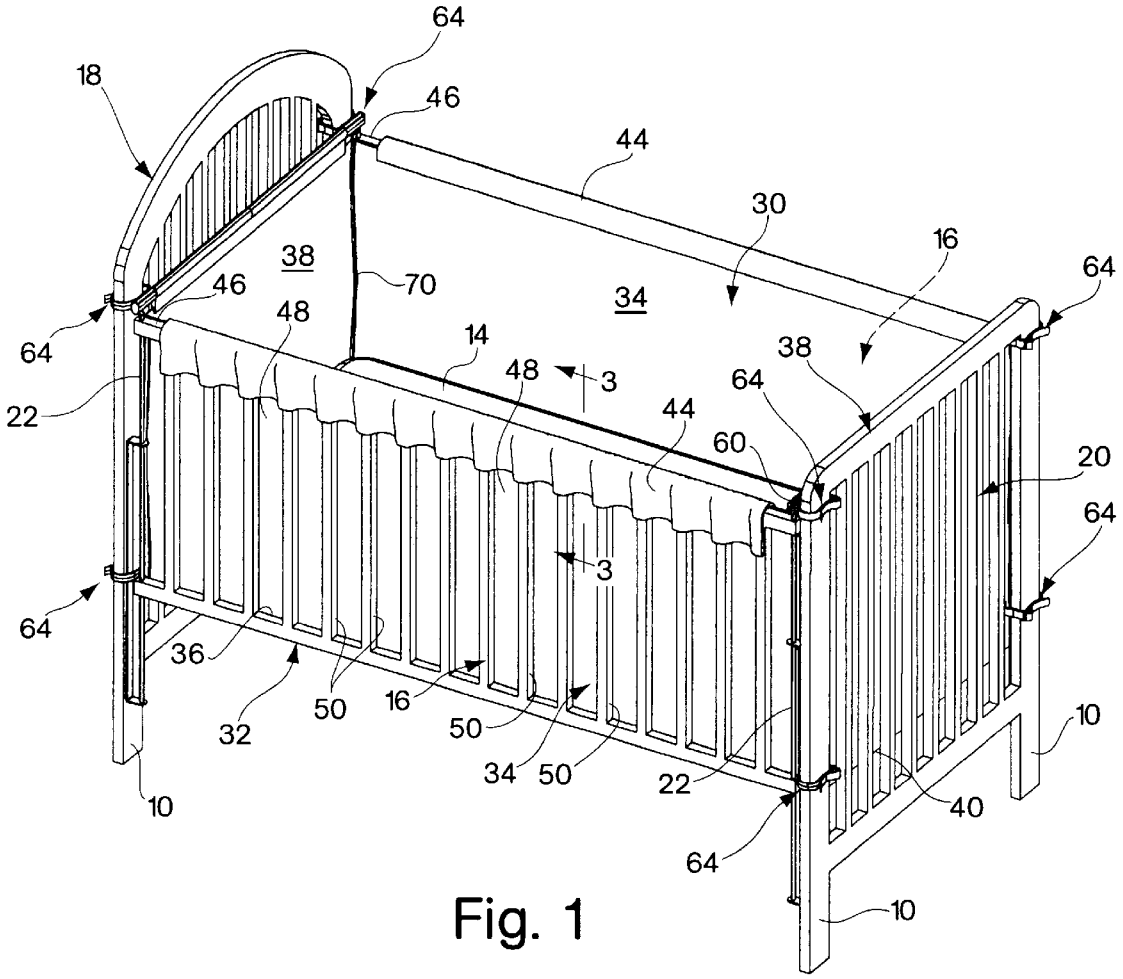
FIG. 1 is a perspective view of a crib fitted with a liner which is constructed in accordance with this invention.

The crib liner of the present invention is designed to be used which conventional cribs such as shown in FIG. 1. The crib includes four corner legs 10, a conventional mattress spring or other base (not shown) supported on the four legs and which in turn supports the crib mattress 14. The crib also includes side rails 16 moveable between the raised position shown in FIG. 1 and lower position shown in FIG. 2, and a head board 18 and foot board 20. The side rails 16 are supported on vertical rods 22 mounted on the head and foot boards, and latches (not shown) are provided to retain the side rails 16 in the raised position. The crib liner 30 that is the subject of the present invention is shown in the drawings disposed within the crib.

The liner 30 includes a rectangular bottom panel 32 which is sized to rest on the mattress spring and is essentially the same size in plan as the spring. Side panels 34 extend upwardly from the side edges 36 of the base panel and may be integrally formed with the base panel. End panels 38 are secured to the front and rear side edges 40 of the bottom panel 32. The side edges of adjacent panels are secured together so as to form a box-like volume that conforms to the inside of the crib in which it is used.

Figure 3:
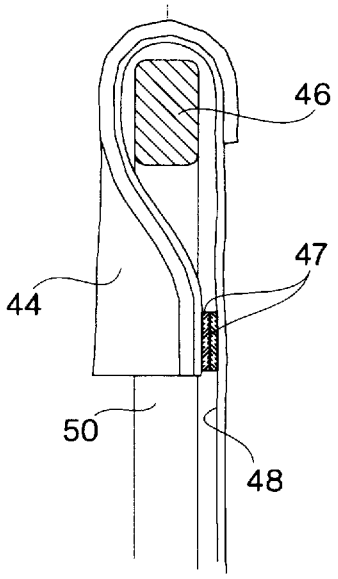
FIG. 3 is a cross sectional view of one side panel of the liner taken along section line 3—3 in FIG. 1 and showing how the liner is attached to the top of the crib side rail.

The top of each side panel 34 carries an extension 44 designed to extend over the top bar 46 of each side rail 16. When positioned in a crib, the extensions 44 extend over the bars 46 and downwardly on the outside of the side rails and are free to engage the outer surfaces 48 of the side panels 34 between the side rail slats 50. To secure the extensions 46 in position over the top bars 46, hook and loop fasteners 47 sometimes marketed under the trademark Velcro ™ are provided on one face of each extension 46 and on the opposed outer face 48 of the corresponding side panels 34 as is best shown in FIG. 3. The strips 54 on the extensions 44 removably lock to the matting strips 56 on the side panels and serve to support the side panels 34 in position on the inside of the side rails 16 of the crib.

The upper ends of the end panels 38 carry sleeves 60 that extend across their upper edges 62. Each sleeve 60 contains a rod 62 that is designed to extend across the width of the head board 18 and foot board 20 of the crib and rest upon the top ends of the rods 22 upon which the side rails 16 move. Each of the sleeves carries a pair of ties 64, each tie including a D-ring 66 and a Velcro-type hook and loop strip 68 that together may serve to lock the rod 62 in position on the upper end of the slide rods 22. This is shown in FIG. 1, wherein the ties are wrapped around the legs or slats of the bead board and foot board and threaded through the D-rings. An additional tie may be provided on each side of the bottom of the end panels 38 to enable the bottom of the end panels to be anchored in place. Those ties may be identical to the ties at the tops of the end panels on the sleeves 60.

In accordance with the present invention, the fabric from which the side and end panels 34 and 38 are made is a fine mesh having openings 70 too small to allow an infant's fingers or toes to extend through the mesh. Therefore, an infant or toddler cannot get a firm grip on the side panels which would enable the child to overcome the holding power of the ties and Velcro-type hook and loop fasteners which secure the end panels and side panels in position or to pull itself up and over the side rails. Nevertheless, the holes are large enough so as to allow adequate ventilation in the crib and enable the child to be viewed through the side panels. Typically, the fabric from which the panels are made may be perforated plastic netting or a woven nonabsorbent yarn so that it can be wiped clean and dry. The openings should not have an effective diameter greater than approximately 3/16 inches so as to assure that neither fingers nor toes can pass through them. The term "effective diameter" is the maximum diameter that the holes may have in any direction even when the fabric is distorted by virtue of its flexibility.

Preferably, the fabric from which the end panels 38 are made is the same webbing material as used in the side panels 34. However, because the end boards of the crib are sometimes solid members as opposed to being made up of vertical slats as in the crib shown, it is not necessary that the vertical end panels be made of a perforated material such as webbing to allow the baby to be viewed through the end panels or to allow for the circulation of air through the fabric about the interior of the crib. The extensions 44 attach to the tops of the side panels 34 as well as the sleeves 60 on the tops of the end panels 38 preferably are made of a quilted material, for example, a three-ply fabric having outer cotton layers and an intermediate cushion layer. The quilted extension 44 and sleeves 60 may be stitched to the netting material from which the side and end panels 36 and 38 are made. The quilted fabric will afford protection for the child should he or she bang its head or limbs against either the tops of the side rails 16 or the rods 62 that support the end panels 38. Moreover, all of the fabrics whether they be netting, quilting or any other form should be easily washable.

Figure 2:
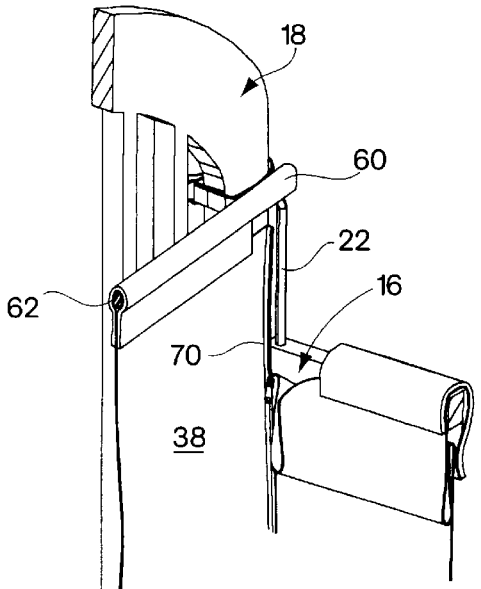
FIG. 2 is a perspective view of the liner shown in FIG. 1 and showing the manner in which the corners of a side panel may be opened to enable a side rail of the crib to be lowered to gain access to the crib interior.

As shown in FIG. 2, zippers 70 join the side edges of the side and end panels 36 and 38. When the zippers 70 at the end of a side panel 36 are opened, the side rail 16 carrying that panel may be readily lowered as the panel 36 will fold over and follow the rail down as suggested in FIG. 2. Preferably zippers are provided at each corner of the liner so that either side rail may be lowered as desired.

Figure 4:
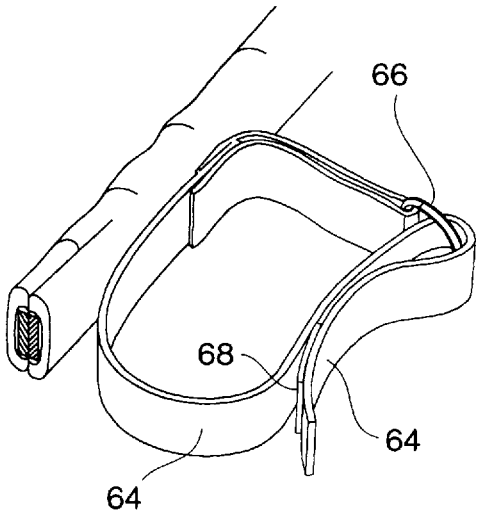
FIG. 4 is a detailed view showing the ties carried by the end panels of the liner.
Figure 5:
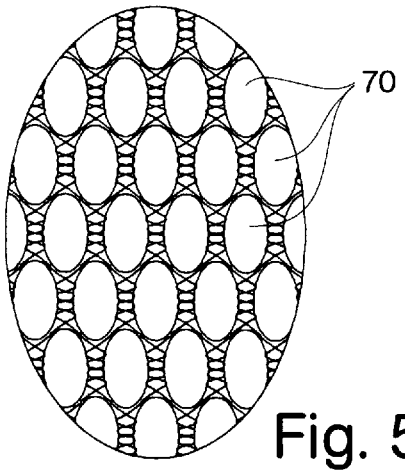
FIG. 5 is a plan view showing details of the netting from which the liner is made.

The liner of the present invention may very easily be installed in a crib as follows: with the zippers 70 at the four vertical corners of the liner closed, and with the mattress removed from the crib, the liner is inserted into the crib on the insides of the side rails 16 and head and foot boards 18 and 20 with the bottom panel of the liner resting on the mattress springs of the crib. When inserted in position, the rods 62 and sleeves 60 at the upper edges of the end panels 38 are placed on the upper ends of the fixed rods 22 that support the side rails and the ties shown in FIG. 4 are secured about the tops of the rods 22 or legs or slats of the boards by sliding one tie through the D-ring 66 and folding the tie back upon itself to lock the Velcro-type hook and loop closure so as to secure the rods and sleeves securely in place. Additional ties connected to the bottoms of the side edges of the end panels 38 are secured to the bottoms of the rods 22, legs 10 or slats of the head and foot boards so as to hold the bottoms of the end panels down against the spring. The side panels 34 of the liner are then secured in place by swinging the extensions 44 carried by the side panels over the tops of the side rails and securing the Velcro-type hook and loop strips on the inside of the extensions to the mating strips on the outside of the side panels 34 between the slats 50. The mattress may be placed in the crib on top of the bottom panel 36 at any time during installation of the liner, and the mattress itself serves to further retain the liner in position. If desired conventional crib bumpers may be placed about the inside of the crib resting on the mattress and the ties normally attached to the bumpers may be threaded through the very small openings in the side and end panels and be tied to the slats in the side rails and the track rods to hold the bumpers in position.

It will be appreciated from the foregoing description that the many Velcro-type ties and closures provided make it virtually impossible for an infant to pull the side and end panels off the crib side rails and head and foot boards respectively. The nesting or mesh material used in the side panels 34 and preferably the end panels 38 as well, is so fine that a child cannot put its fingers through the openings so as to firmly grasp the fabric and pull any of the panels down.

When mounted as described, it is evident that a child cannot extend any of its limbs out of the crib between the slats 50 because of the screen provided by the lining. The lining however does not interfere with the raising and lowering of the side rails because the corners of the liner can be opened by virtue of the zippers, which will allow the extensions carried by the side panels to follow the upper bar of the side rails when one or both is lowered as suggested in FIG. 2.

Having described this invention in detail, those skilled in the art will appreciate that numerous modifications may be made thereof without departing from the spirit of this invention. Therefore, it is not intended that the scope of the invention be limited to the specific embodiments illustrated and described. Rather, its breadth is to be determined by the appended claims and their equivalents.

What is claimed is:

1. A liner for baby cribs having movable side rails made up of a top bar and vertical slats, a bottom wall, a mattress, a head board and foot board comprising a bottom panel and two side panels and two end panels attached together as a unitary and flexible box-like structure for placement in the crib on the insides of the side rails and end boards and below the mattress, said side panels being made of a mesh-type netting and having upper edges, said netting having openings which are too small to permit an infant to insert a finger or toe there through, a quilted extension secured to the upper edge of each side panel for extending over the top bar and down on the outside of the vertical slats of the side rails of the crib, fasteners provided in the side panels and extensions for securing those panels and extensions together between the vertical slats, and separate fasteners secured to the end panels for securing those panels to the tops of the head and foot boards.

2. A crib liner as defined in claim 1 wherein the end panels and side panels have side edges which are secured together to hold the liner in a box-like configuration, the side edges of at least one of the side panels being releasably secured to the adjacent side edges of each of the end panels permitting that side panel to fold over and remain attached to the crib rail on which it is mounted when the crib side rail is lowered and raised.

3. A crib liner as defined in claim 2 wherein the one side panel of the liner is releasably secured to the end panels by zippers.

4. A crib liner as defined in claim 1 wherein the fasteners provided in the side panels and extensions are hook and loop-type fasteners.

5. A crib liner as defined in claim 4 wherein the separate fasteners are ties attached to the upper ends of the end panels.

6. A liner for baby cribs having movable side rails made up of a top bar and vertical slats, a bottom wall, a mattress, a head board and foot board comprising a bottom panel and two side panels and two end panels attached together as a unitary and flexible box-like structure for placement in a crib on the insides of the side rails and end boards and below the mattress, said side panels being made of a mesh-type netting and having upper edges, said netting having openings that allow air to freely circulate in the crib but are too small to enable an infant to insert its fingers or toes therethrough, an extension on the upper edge of and forming part of each side panel for extending over the top bar and down on the outside of the vertical slats of the side rails of the crib, fasteners provided on the side panels for securing those panels together between the vertical slats, and additional fasteners secured to the end panels for securing those panels to the tops of the head and foot boards.

7. A liner as defined in claim 6 wherein the extensions are made of a soft and flexible quilted material.

8. A liner as defined in claim 6 wherein at least one of the side panels is releasably secured to the end panels.

* * * * *